United States Patent [19]

Murukurthy

[11] 4,026,385

[45] May 31, 1977

[54] LADDERLESS SAFETY ESCAPE DEVICE

[76] Inventor: Rao K. Murukurthy, 413 High St., Monroe, N.Y. 10950

[22] Filed: Jan. 19, 1976

[21] Appl. No.: 650,312

[52] U.S. Cl. ..... 182/75; 182/7

[51] Int. Cl.[2] ..... A62B 1/10

[58] Field of Search ..... 182/73, 74, 75, 5–7; 254/151, 152, 153, 154, 155

[56] References Cited

UNITED STATES PATENTS

| | | | |
|---|---|---|---|
| 380,284 | 3/1888 | Hornby | 182/75 |
| 1,998,262 | 4/1935 | Tolstad | 254/151 |
| 2,205,026 | 6/1940 | Barham | 254/154 |
| 2,409,767 | 10/1946 | Larson | 182/73 |
| 2,557,483 | 6/1951 | Tarasiuk | 254/155 |
| 2,558,122 | 6/1951 | Barry | 254/154 |
| 2,569,597 | 10/1951 | Bailey | 254/154 |

*Primary Examiner*—Reinaldo P. Machado
*Attorney, Agent, or Firm*—Joel Halpern

[57] ABSTRACT

A ladderless safety escape device includes a cable drum upon which a cable is wound having means secured to the free end thereof for the support of a person. A braking mechanism is operatively connected to the cable drum for controlling the rate of descent of the person. A brake control mechanism is provided for operatively disconnecting the brake mechanism from the cable drum during rewinding of the cable and insures operative connection of the brake mechanism and cable drum during unwinding of the cable.

4 Claims, 3 Drawing Figures

LADDERLESS SAFETY ESCAPE DEVICE

BACKGROUND OF THE INVENTION

The present invention relates to fire escape devices and more particularly to a ladderless safety escape device including a cable drum and brake mechanism therefor.

Ladderless safety escape devices of the character described have been known heretofore. The brake mechanism is an extremely important cmponent of such devices. As might be expected, confidence in devices of this type depends to a large extent upon the reliability of the braking system and upon the safeguards provided to insure against the inadvertent uncontrolled descent of the person being lowered to safety. It is also a safety factor in insuring that the cable drum is locked against accidental unwinding of the cable from the drum before the person is properly secured in the seat or chair. Prior devices did not provide mechanism which were sufficiently reliable in these respects so as to stimulate the degree of confidence in such safety escape devices as is necessary for their widespread acceptance by the general public.

SUMMARY OF THE INVENTION

It is one object of this invention to provide a ladderless safety escape device whereby a person may be lowered to safety from an elevated level of a building at a controlled rate of descent and which includes brake control mechanism which automatically prevents unwinding of the cable unless the brake mechanism is operatively connected to the drum.

It is another object of this invention to provide a ladderless safety escape device for lowering a person to safety from an elevated level of a building at a controlled rate of descent and which includes mechanism for locking the cable drum against accidental unwinding of the cable and for manual release by the person to be lowered after he has been secured preperly in the lowering support seat.

Other objects and advantages of the invention will become readily apparent from the following description of the invention.

According to the present invention there is provided a ladderless safety escape device comprising in combination: a frame; a cable drum mounted rotatably in the frame; a cable wound upon the drum and having means secured to the free end thereof for the support of a person; a braking mechanism for the drum mounted concentrically about a portion thereof for controlling the rate at which the cable is unwound to thereby regulate the rate of descent of the person; a brake control mechanism adapted to selectively operatively connect and disconnect the braking mechanism and the cable drum, including means for automatically connecting the braking mechanism and cable drum in the event the cable drum begins to unwind without being operatively connected to the braking mechanism; manually operable cable drum control means for selectively locking the drum against rotation; and a rewind handle connectd to the cable drum for rewinding of the cable thereon.

BRIEF DESCRIPTION OF THE DRAWINGS

In order that the invention may be more fully understood it will now be described, by way of example, with reference to the accompanying drawings in which.

DETAILED DESCRIPTION

Figure 1:
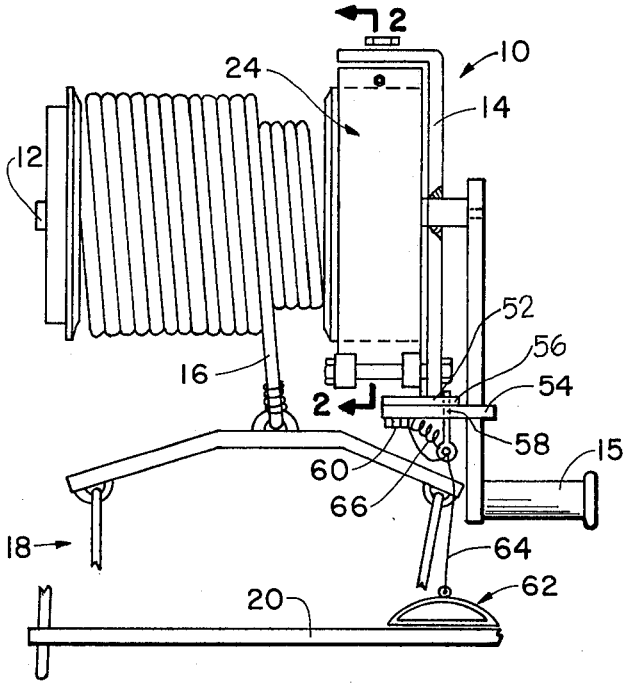
FIG. 1 is a side elevational view of the ladderless safety escape device embodying the invention.

Referring to the drawings there is shown generally a ladderless safety escape device 10 which can be mounted by any suitable means preferably on the outside of a building in the immediate vicinity of a window for convenient availability to persons occupying an upper story of the building.

The escape device comprises a cable drum 12 mounted rotatably in frame 14 only a portion of which is shown. It will be understood that standard channel or equivalent structural members may be welded or otherwise securely joined to the main body of the frame so that the escape device can be installed on the side of a building. Alternatively the entire unit may be enclosed within a housing and stored inside the building beneath a window.

It will be understood, of course, that in referring to the use of a cable drum it is contemplated that a flanged pulley may be employed or a cable shaft one end of which may be provided with a brake mechanism to be described here-after. A rewind handle 15 is secured to the brake end of the drum for rewinding the cable thereon after someone has been lowered to safety and in preparation for the lowering of the next person.

A cable 16 is wound upon the drum and has its free end connected to a support structure 18, which desirably includes a seat element 20 and a safety belt 22, for supporting a person to be lowered to safety from the building. Although the term cable is used throughout the specification and in the appended claims it will be appreciated that this term has been employed in its generic sense and includes ropes and wire elements whether formed of natural or synthetic fibers or of metal.

Figure 2:
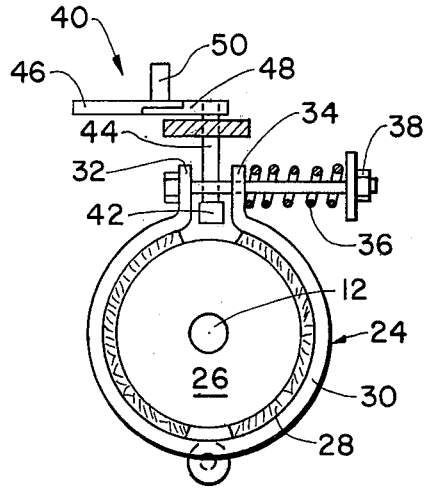
FIG. 2 is a view, partly in section, of the device shown in FIG. 1 taken along line 2—2 thereof.

A braking mechanism 24 is mounted concentrically about the cable drum or an extension of the shaft thereof and may incude a brake drum 26, and brake lining 28 and brake band 30. It wll be observed that the brake lining and brake band do not extend completely about the cable drum, the brake lining being split as illustrated in FIG. 2 and the brake band having its circumferential end portions 32, 34 extending in a generally radial direction and in spaced relation. A spring 36, desirably a coiled compression spring, is mounted so as to normally bias the brake band to exert a radially directed braking force through the brake elements on the cable drum or its shaft. In this manner a sufficient braking force is applied to the drum so as to afford a regulated rate at which the cable is unwound and at which the person is lowered. Such rate of descent may be varied by adjusting the spring tension in a known manner such as through the tightening of a nut 38.

A brake control mechanism is indicated generally as 40. The purpose of this control mechanism is to provide a safety against accidental release of the cable drum when the brake is not in operative connection therewith. The control mechanism includes a brake cam 42 mounted fixedly upon a shaft 44. The cam is positioned between the spaced brake band ends and is pivotable between a first position in which such ends are urged apart by the cam against the bias of spring 36 to thereby remove the braking force from the cable drum and a second position out of engagement with such ends. In the second position the spring 36 is free to bias the ends towards each other and apply a braking force to the cable drum or to the brake drum which constitutes an extension of the cable drum.

Figure 3:
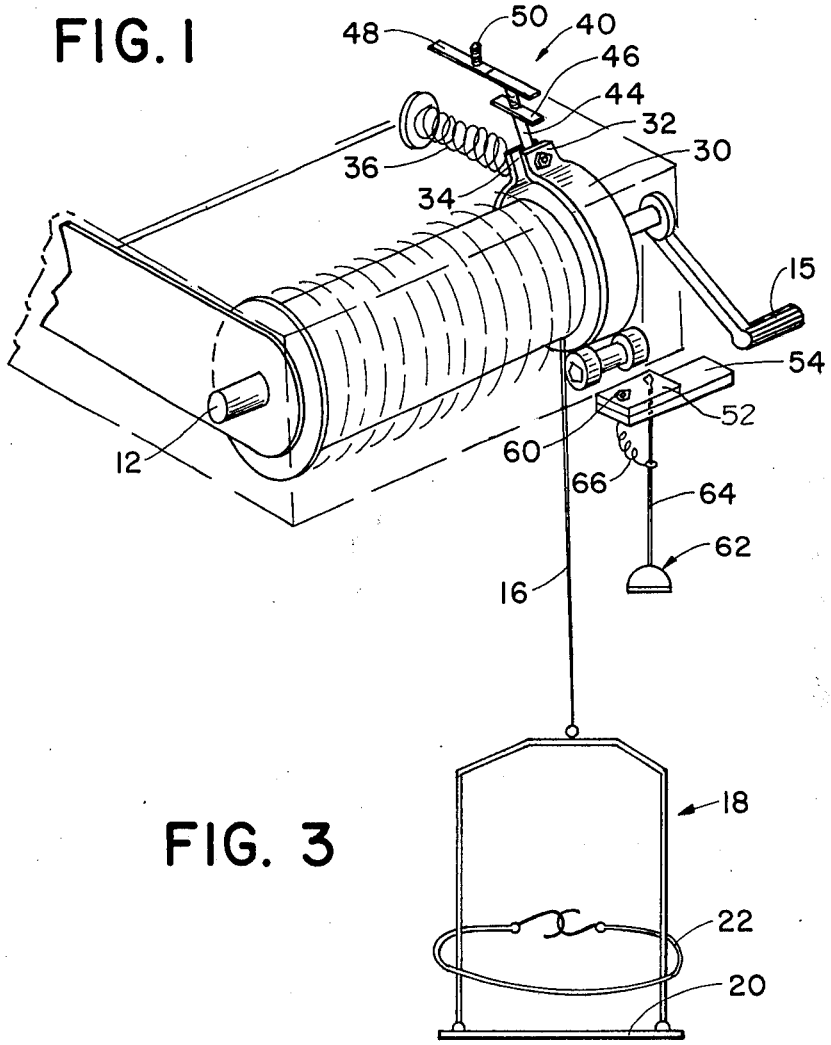
FIG. 3 is a perspective schematic view of the device shown in FIG. 1 with the support chair partly lowered.

The shaft 44 is journaled in the frame and carries at its upper end a lever member having first and second sections 46, 48. Section 46 surmounts the shaft and section 48 extends outwardy therefrom a sufficient distance so as to project into the rotational path of rewind handle 15 when the lever has been shifted clockwise 90° from the position shown in FIG. 3. Alternatively the lever sections may comprise coperable components of a ratchet (not shown) by means of which one of such sections is pivotable relative to the other and is positionable, when the brake control mechanism is disconnected as depicted by brokenline in FIG. 3, within the path of rotation of rewind handle 15 constructions are well known and the present specification will not be unnecessarily encumbered with a detailed description in this respect. Suffice to state that the lever sections 46, 48 and stud so are so arranged as to enable one to move cam 42 into either of its first or second positions by means of stud 50. Thus, with the brake cam 42 pivoted into its first position as shown by broken line in FIG. 3 the ratchet lever 48 is shifted into the path of rotation of rewind handle 15. During the rewinding of the cable drum lever 48 is pivotable relative to lever section 46. Once rewinding of the cable has been completed one should pivot the cam into its second position by means of stud 50 so that the braking mechanism is once again operativey connected the cable drum. However, in the event that this is inadvertantly not done the lever arrangement serves as an automatic safety device. In such event as soon as the cable begins to unwind the handle 15 will engage with lever section 48 which is in the path of rotation of the handle. The striking of the lever section 48 by handle 15 will cause the lever to shift the substantially 90° so that cam 42 is moved into its second position as shown in FIG. 2 out of contact with the spaced ends of the brake band thus permitting spring 36 to apply a braking force to the cable drum.

In order that the person to be lowered may directly control the release of the cable drum a quick release mechanism is provided. Thus, a stationary element 52 is secured to the frame 14 as by welding. A link or arm 54 is pivotably mounted on element 52 as by means of a pivot pin 55. Apertures 56, 58 are formed in stationary element 52 and in link 54 is aligned relation. A pin 60 is dimensioned to fit snugly within the aligned apertures, and in such condition the link element 54 extends into the path of rotation of handle 15 and prevents rotation of the cable drum. In this state the cable cannot be unwound. Once the person is loaded and properly secured in seat 20 the pin can be pulled out of the apertures by means of handle 62 which is connected to the pin by chain 64. The cable will then unwind from the drum and the person will be lowered at a controlled rate of descent since the cable drum will unwind under the influence of the braking mechanism hereinbefore discussed. To facilitate reception and retention of the pin 60 within the aligned apertures the pin may be tapered. As will be observed in FIGS. 1 and 3 a spring 66 may be provided to retain the pin and handle assembly while the person is being lowered.

From the foregoing it will be seen that a safety escape device has been provided which is operative without the need for a ladder and which provides for an automatic control of the braking mechanism so that there is no danger of accidental release of the drum at any time without the influence of the braking mechanism. Thus, the drum will only spend cable therefrom at a controlled rate. Also, the quick release mechanism insures that manual control of the cable drum is afforded. The person to be lowered can, in the manner described, determine exactly when his controlled rate of descent should commence. This combination of features should impart to ladderless escape devices a degree of public acceptance not enjoyed heretofore.

I claim:

1. A ladderless safety excape device comprising in combination:

a frame;

a cable drum mounted rotatably in said frame;

a cable wound upon said drum and having means secured to the free end thereof for the support of a person;

a braking mechanism for said drum for controlling the rate at which said cable is unwound to thereby regulate the rate of descent of the person, said brake mechanism including an outer element concentrically positioned about said drum and having free end portions extending in a generally radial direction in spaced relation to each other, spring means adapted to normally bias said free end portions towards each other to thereby apply a braking force to said cable drum;

a brake control mechanism adapted to selectively operatively connect and disconnect said braking mechanism and said cable drum, incuding means for automatically connecting said braking mechanism and cable drum in the event said cable drum begins to unwind without being operatively connected to said braking mechanism, said automatic connecting means including a brake cam mounted between said spaced end portions of said braking mechanism pivotable between a first position engageable with said end portions to urge same apart against the bias of said spring means to remove the braking force from said cable drum and a second position out of engagement with said end portions to thereby permit said spring means to bias said outer concentric element radially inwardly and thereby apply said braking force to said cable drum, lever means being connected to said brake cam and adapted to be shifted into the path of rotation of a rewind handle for said drum when said brake cam is in its said first position and to cause said cam to pivot into its said second position upon engagement by the rewind handle upon rotation of said cable drum;

manually operable cable drum control means for selectively locking said drum against rotation;

and a rewind handle connected to said cable drum for rewinding of the cable thereon.

2. A safety escape device according to claim 1, including a shaft fixedly carrying said brake cam adjacent the lower end thereof, a lever carried by the upper end of said shaft having a section thereof shiftable into the rotative path of said rewind handle when said brake cam is pivoted into its said first position, said rewind handle, upon rotation of the cable drum in a direction unwinding the cable, being engageable with said lever section to pivot same and said shaft to thereby move said brake cam into its said second position to thereby permit said spring means to apply a braking force to said cable drum.

3. A safety escape device according to claim 1, wherein said cable drum control means includes a first stationary element and an arm secured pivotably thereto and extendable into the rotative path of said rewind handle, said stationary element and pivotable arm having alignable apertures therein, a pin member dimensioned to snugly fit within the said apertures when aligned to thereeby prevent pivoting of said arm, and handle means for removing said pin from said aligned apertures to thereby enable said arm to pivot out of the rotative path of the rewind handle to free said cable drum for unwinding of the cable.

4. A safety escape device according to claim 1, wherein said braking mechanism incudes a brake drum concentrically mounted about an extension of said cable drum.

* * * * *